US005645094A

United States Patent [19]

Wu

[11] Patent Number: 5,645,094

[45] Date of Patent: Jul. 8, 1997

[54] MULTIPLE-FOLD AUTOMATIC UMBRELLA WITH REINFORCED RIBS AND SIMPLIFIED MECHANISM

[76] Inventor: Woh-Wen Wu, P. O. Box 10160, Taipei (100), Taiwan

[21] Appl. No.: 743,345

[22] Filed: Nov. 4, 1996

Related U.S. Application Data

[63] Continuation-in-part of Ser. No. 654,142, May 28, 1996, Pat. No. 5,617,889.

[51] Int. Cl.[6] ..... A45B 25/14

[52] U.S. Cl. ..... 135/24; 135/39; 135/31

[58] Field of Search ..... 135/38, 39, 41, 135/31, 29, 22, 24, 40

[56] References Cited

U.S. PATENT DOCUMENTS

| | | | |
|---|---|---|---|
| 426,454 | 4/1890 | Ledig | 135/39 |
| 2,782,795 | 2/1957 | Small | 135/40 X |
| 4,941,494 | 7/1990 | Wu | 135/24 X |
| 5,178,174 | 1/1993 | Wu | 135/24 X |
| 5,337,770 | 8/1994 | Wang | 135/29 X |
| 5,441,065 | 8/1995 | Lin et al. | 135/24 |
| 5,472,006 | 12/1995 | Kuo et al. | 135/29 X |
| 5,505,222 | 4/1996 | Lin et al. | 135/24 |

*Primary Examiner*—Lanna Mai

[57] ABSTRACT

A multiple-fold automatic umbrella includes a lower runner of the umbrella ribs having a rope guiding member longitudinally formed on the runner provided with two rope grooves in two opposite sides of the rope guiding member for an easy winding of the rope on a roller rotatably mounted on the runner; a coupling spring compressibly retained between a middle shaft and an inner block adjacent to the upper notch of the umbrella ribs; at least an engaging hole formed in a lower portion of the upper shaft having a convex portion curved outwardly from the upper shaft and positioned below the engaging hole for stably engaging a wedge portion of the control device when folding the umbrella; and a resilient rib slidably coupled by a coupling ring to the middle rib and is made to prevent dogging with the coupling ring when the umbrella ribs are bent upwardly by a strong upward wind force.

4 Claims, 5 Drawing Sheets

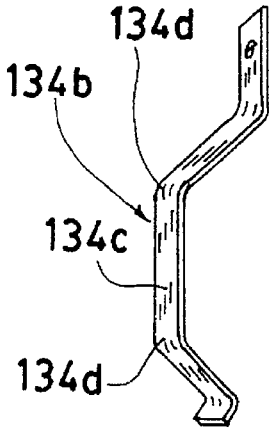
FIG. 3
FIG. 4
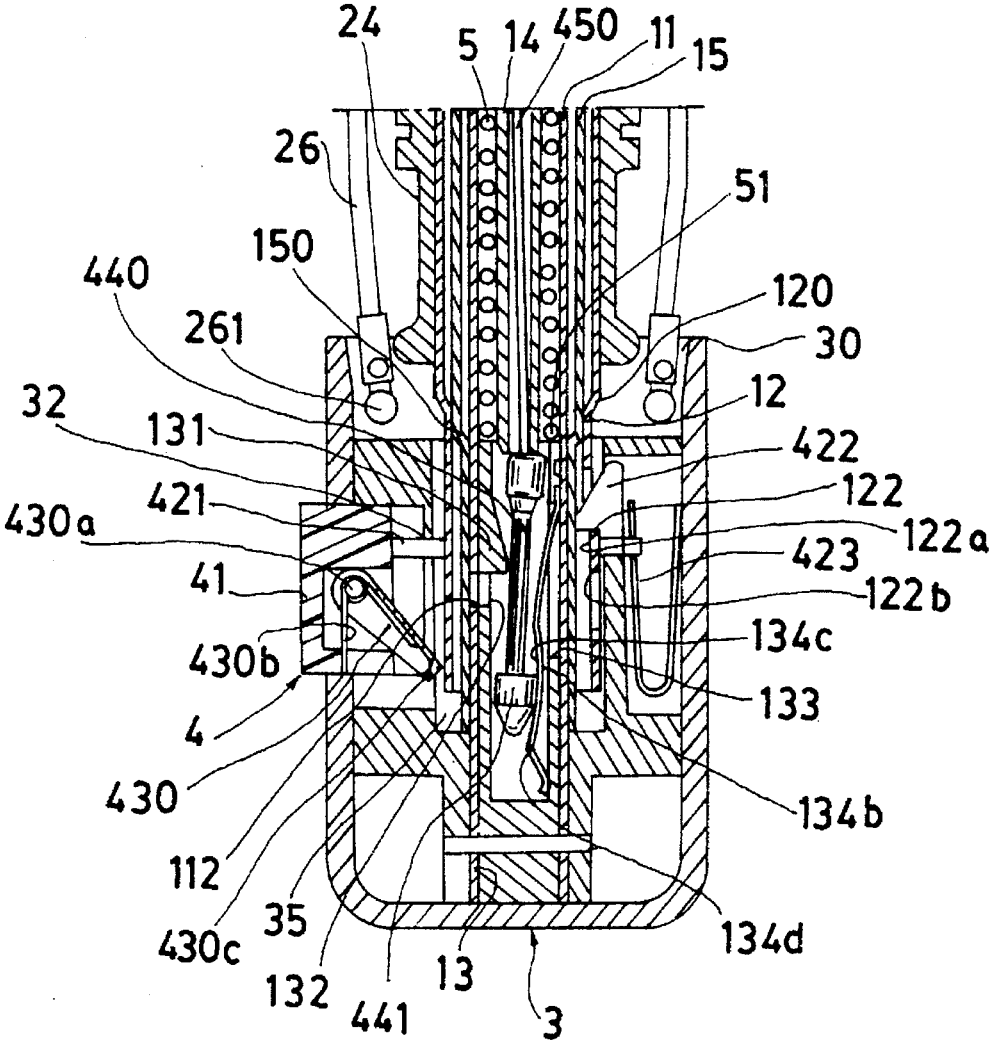

FIG. 5
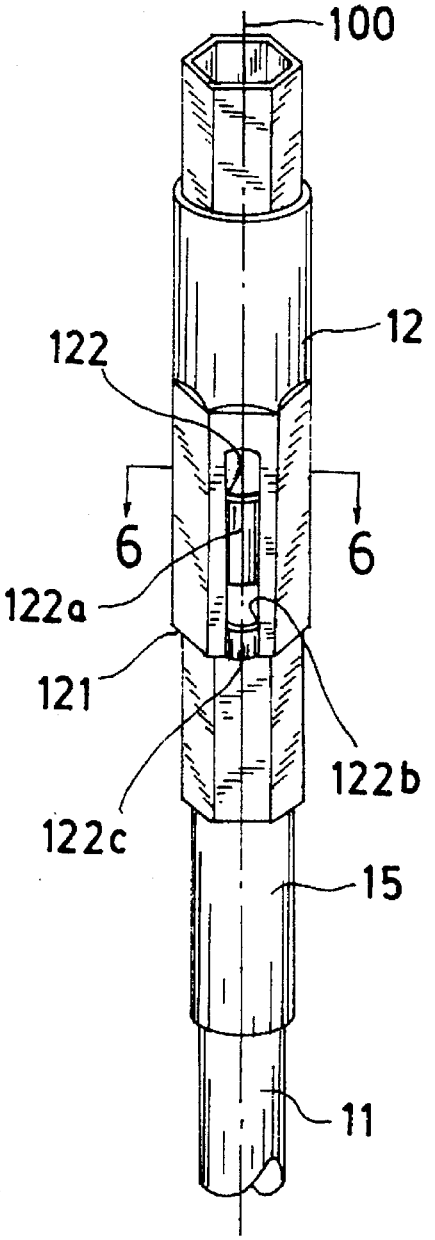
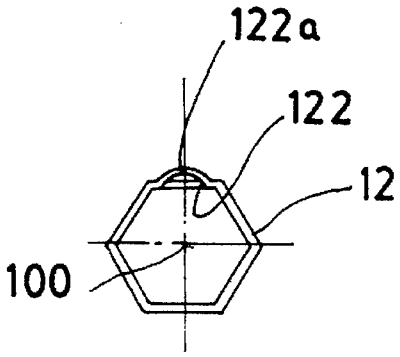
FIG. 6
FIG. 7
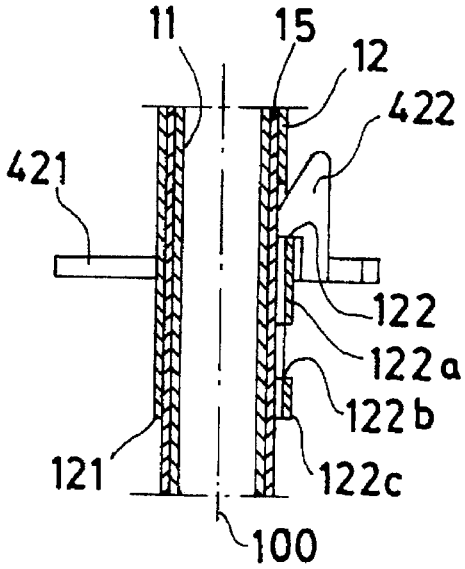
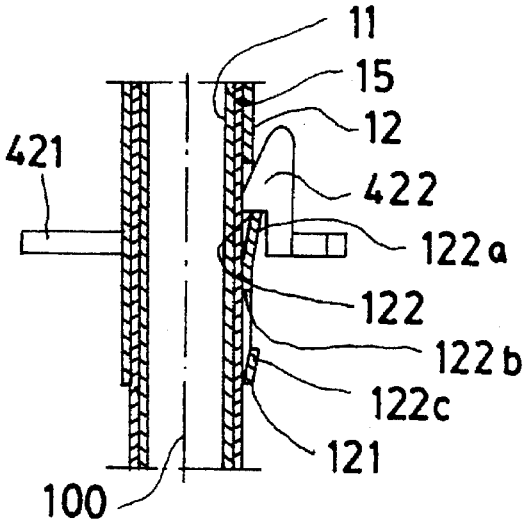
FIG. 8

MULTIPLE-FOLD AUTOMATIC UMBRELLA WITH REINFORCED RIBS AND SIMPLIFIED MECHANISM

BACKGROUND OF THE INVENTION

This application is a continuation-in-part (C-I-P) of its parent application of U.S. Ser. No.: 08/654,142, filed: May 28, 1996 by the same inventor of this application now U.S. Pat. No. 5,617,889 issued on Apr. 4, 1997.

The original parent application discloses reinforced ribs and simplified mechanism of an automatically closing and opening umbrella, which however may have the following drawbacks:

1. The rope 450 is guided in the rope channel 240 of the lower runner 24. It is very difficult to wind the rope 450 into the deep narrow channel 240 longitudinally formed in the runner 24 as shown in FIGS. 4, 4A, 4B and 4C of the parent application, thereby increasing the assembly complexity and increasing the production cost of the umbrella.

2. The coupling sleeve 17 (original FIGS. 3B, 3) is a rigid sleeve provided in between the upper portion of the middle shaft 15 and the inner block 123 adjacent the upper notch When it is intended to further shorten the retracted shafts from original FIG. 3 such as to retract the tips of the rear ribs into the grip 3, the coupling sleeve 17 is rigidly packed between the inner block 123 beneath the upper notch 21 and the middle shaft 15 of which the lower end portion 151 of the middle shaft 15 has reached the bottom of the grip 3 (FIG. 3 of parent application), thereby being incompressible for minimally shortening the folded shaft means 1.

3. The resilient plate **134*a* (original FIGS. 1A, 1) is formed as a triangular shape having a single angled portion convex towards a center of the shaft means 1. The single angled portion may be easily deformed as resiliently biasing the locking head portion 441** to influence the control mechanism of the automatic umbrella.

4. In order to stably lock the middle shaft 15 and the upper shaft 12 as shown in FIGS. 3A, 3 of the parent application by the wedge portion 422 of the opening controller 42 when folding the umbrella, both middle shaft 15 and the upper shaft 12 should be respectively formed with engaging holes 153, 122 to thereby increase the processing step and the production cost when making the umbrella.

5. As being further illustrated in FIGS. 11, 12 of this application, the resilient rib **25*a* has its inner rib end 251*a* pivotally connected with the top rib 22 and having an outer rib end 252*a* of the resilient rib 25*a* pivotally connected to the outer joint member 27 connected with the rear rib 26, with a central U-shaped portion 25*a* of the resilient rib 25*a* slidably engageable with the middle rib 25 having a cross section of U shape as coupled by a coupling ring 29. Since the height h of an inner arm portion 25*i* of the central U-shaped portion 25*u* of the resilient rib 25*a* is equal to the height h of an outer arm portion 25*j* of the central U-shaped portion 25*u*, and the height h is slightly larger than a value (d–t) in which "d" is an inside diameter d of the coupling ring 29 and "t" is a thickness of the U-shaped middle rib 25, the inner arm portion 25*i* of the U-shaped portion 25*u* of the resilient rib 25*a* will be dogged by the coupling ring 29 when the umbrella ribs are subjected to a wind force W forcing the ribs upwardly as shown in FIG. 11 by "sinking" an inner portion of the rib 25*a* into the U-shaped 25**, thereby influencing a smooth operation of the umbrella.

The present inventor has found the drawbacks of the parent application and has made some improvements for overcoming the drawbacks of the parent application.

SUMMARY OF THE INVENTION

The object of the present invention is to provide a multiple-fold automatic umbrella including a lower runner of the umbrella ribs having a rope guiding member longitudinally formed on the runner provided with two rope grooves in two opposite sides of the rope guiding member for an easy winding of the rope on a roller rotatably mounted on a roller shaft integrally formed on the runner; a coupling spring compressibly retained between a middle shaft and an inner block adjacent to the upper notch of the umbrella ribs for replacing a rigid coupling sleeve retained on the middle shaft; at least an engaging hole formed in a lower portion of the upper shaft having a convex portion curved outwardly from the upper shaft and positioned below the engaging hole for stably engaging a wedge portion of the control device when folding the umbrella; a resilient plate convex inwardly in the central shafts having a flat spring portion disposed between two angled spring portions for preventing deformation of the resilient plate when resiliently biasing a locking head portion of the umbrella control device for opening and closing the umbrella; and a resilient rib connected between the top rib and the rear rib of the umbrella ribs having a longer inner arm port ion of a central U-shaped portion of the resilient rib slidably coupled by a coupling ring to the middle rib of the umbrella ribs in comparison with a shorter outer arm portion of the central U-shaped portion to prevent dogging of the inner arm portion by the coupling ring when the umbrella ribs are bent upwardly by a strong upward wind force.

BRIEF DESCRIPTION OF THE DRAWINGS

FIG. 3 is a perspective view of the resilient plate of the present invention.

FIG. 4 is a sectional drawing of the present invention when further retracted from FIG. 1.

FIG. 5 is an illustration showing two engaging holes formed in the upper shaft of the central shaft means of the present invention.

FIG. 6 is a cross sectional drawing as viewed from 6—6 direction of FIG. 5.

FIG. 7 is an illustration showing the locking of the shafts by a wedge portion of the present invention.

FIG. 8 is another preferred embodiment of the present invention when modified from FIG. 7.

DETAILED DESCRIPTION

Figure 1:
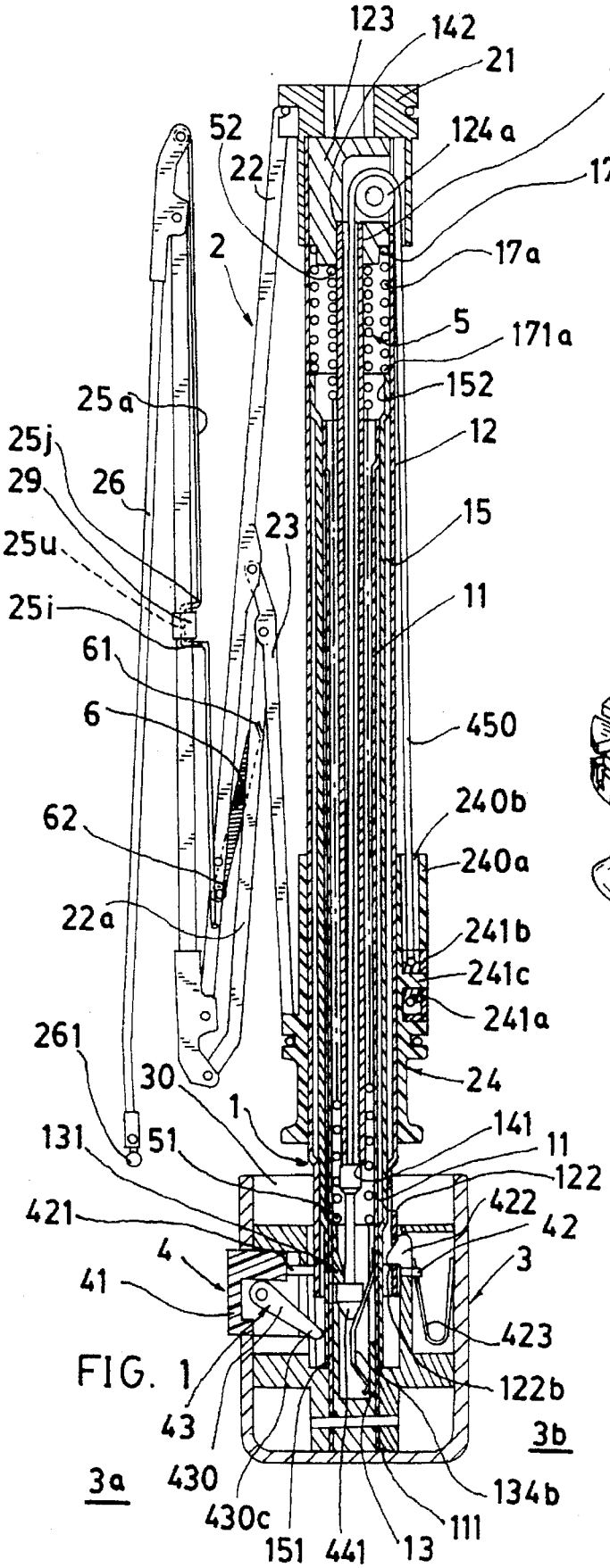
FIG. 1 is an illustration of a folded umbrella of the present invention.
Figure 2:
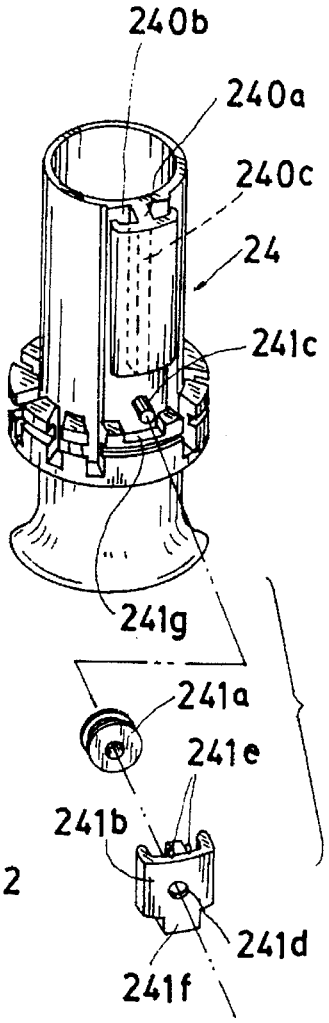
FIG. 2 is an exploded view of the lower runner of the present invention.

As shown in FIGS. 1–10, the present invention comprises: a central shaft means 1 defining a longitudinal axis 100 in a center of the shaft means 1, a rib assembly 2 for securing an umbrella cloth (not shown) on the rib assembly 2, a grip 3, a control means 4, an extending (or opening) spring 5, and a plurality of retraction restoring (or closing) springs 6.

The central shaft means 1 includes; a lower tubular shaft 11 having a lower end portion 111 fixed in the grip 3 having a first side 3*a* of the grip 3 formed with a push button 41 of the control means 4; a middle tubular shaft 15 slidably engageable with the lower shaft 11 having a lower end portion 151 formed on a lower portion of the middle shaft 15 and having an upper enlarged portion 152 formed on an upper portion of the middle shaft 15; an upper tubular shaft 12 slidably engageable with the middle tubular shaft 15, a lower end portion 121 formed on a lower end of the upper shaft 12, a lower engaging hole 122 formed in a lower portion of the upper shaft 12, a lower convex portion 122*a* curved outwarldy from the longitudinal axis 100 of the shaft means 1 and positioned below the lower engaging hole 122, a lowest engaging hole 122*b* formed in a lowest portion of the upper shaft 12 below the lower convex portion 122*a*, and a lowest convex portion 122*c* positioned below the lowest engaging hole 122*b* adjacent to the lower end portion 121 of the upper shaft 12 at a second side 3*b* of the grip 3 (FIGS. 5–8), and an upper inner block 123 formed in an upper end portion of the upper shaft 12 having a guiding roller 124*a* rotatably mounted in the inner block 123 of the shaft 12; a lower sleeve 13 fixed in the grip 3 within the lower shaft 11 having a triangular block portion 131 formed the lower sleeve 13 inclined inwardly downwardly; an upper sleeve 14 having a lower sleeve end portion 141 protruding into the middle shaft 15 when opening the umbrella and having an upper sleeve end portion 142 fixed in the inner block 123 of the upper shaft 12 with the extending spring 5 jacketed on the upper sleeve 14 to be slidably engageable with the upper sleeve 14 to prevent tangling of the spring 5; a coupling spring 17*a* having a lower spring end 171*a* retained on the upper enlarged portion 152 of the middle shaft 15, and an upper spring end 172*a* retained against the inner block 123; with the middle shaft 15 having the lower end portion 151 retained on a lower portion in the grip 3. Due to the convex portion 122*a* or 122*c*, the engaging hole 122 or 122*b* may be stably engaged with the wedge portion 422 when folding the umbrella.

The convex portion 122*a*, 122*c* as shown in FIGS. 5–7 may be modified to be a convex portion tapered downwardly as shown in FIG. 8.

Figures 9, 10:
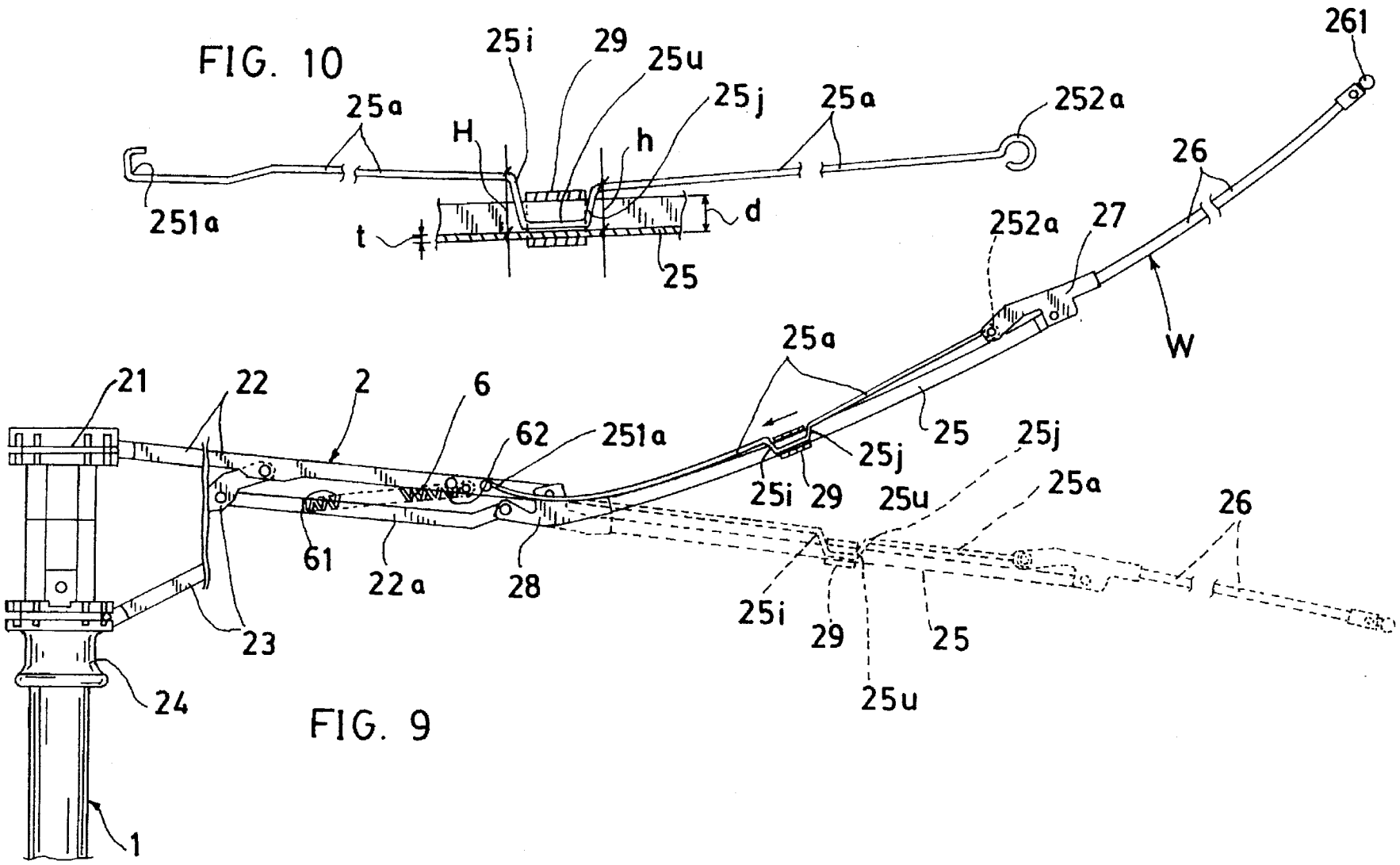
FIG. 9 is an illustration of the present invention when subjected to upward wind force.
FIG. 10 is an illustration showing a resilient rib of the present invention.
Figures 11, 12:
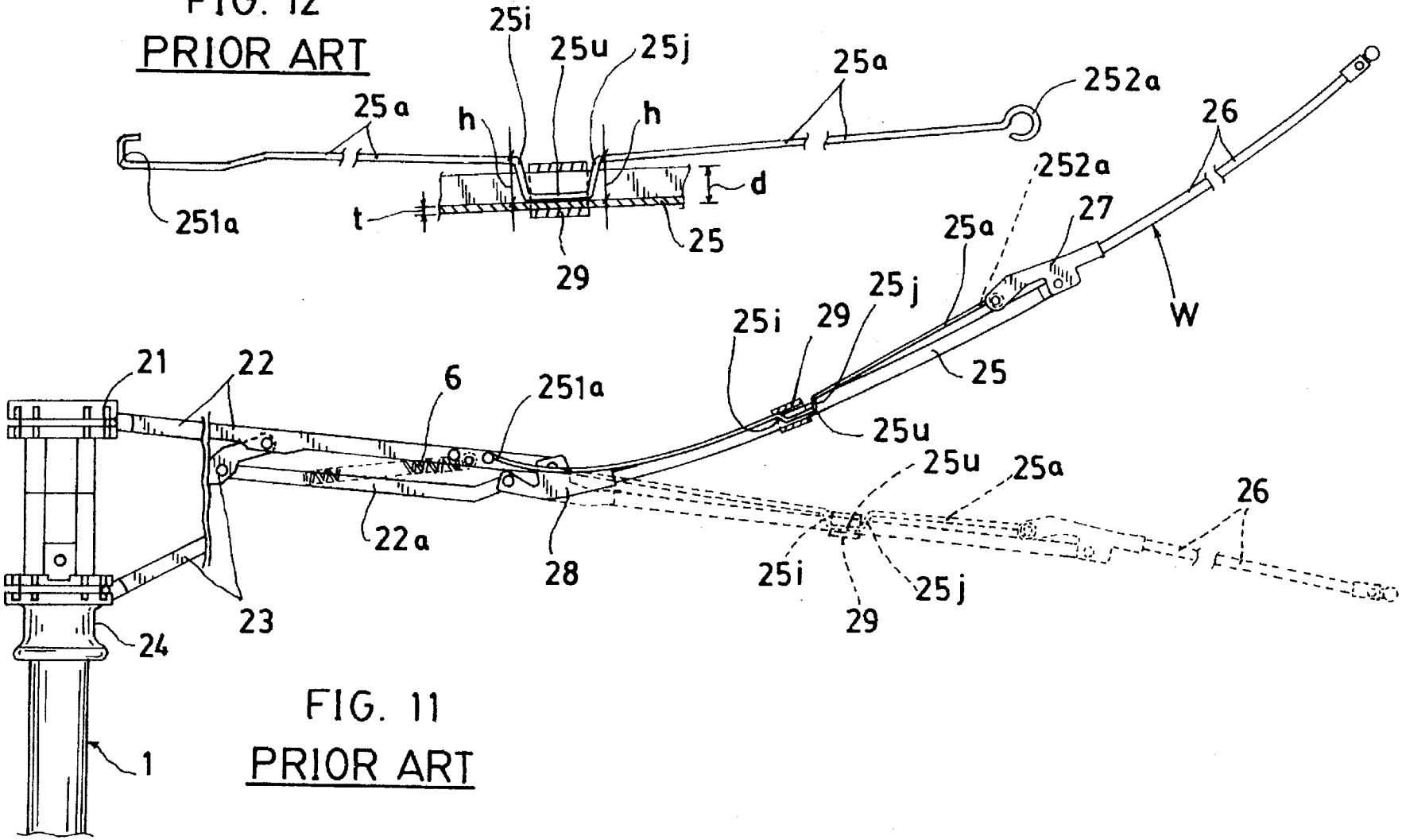
FIG. 12 PRIOR ART
FIG. 11 PRIOR ART
FIG. 11 shows an umbrella of the parent application when subjected to an upward wind force.
FIG. 12 shows a resilient rib of the parent application.

The rib assembly 2 as shown in FIGS. 1, 9 and 10 includes: an upper notch 21 secured on a top portion of the upper shaft 12, a plurality of top ribs 22 each top rib 22 pivotally secured to the upper notch 21. a plurality of stretcher ribs 23 each stretcher rib 23 pivotally secured to each top rib 22 and a lower runner 24 slidably held on the middle and upper shafts 15, 12. a plurality of middle ribs 25 each middle rib 25 pivotally connected to the top rib 22 through a middle joint member 28. a plurality of outer ribs 26 each outer rib 26 having an inner end portion of the outer rib 26 secured to an outer joint member 27 which is pivotally connected with an outer end portion of each middle rib 25 and an outer end portion of a resilient rib 25*a*, and a plurality of connection ribs 22*a* each having its inner end portion pivotally secured to an outer end portion of each stretcher rib 23 and having an outer end portion of the connection rib 22*a* pivotally secured to the middle joint member 28 which is secured with the middle rib 25.

The resilient rib 25*a* has its inner rib end 251*a* secured to the outer portion of the top rib 22, and has an outer rib end 252*a* secured to the outer joint member 27. The resilient rib 25*a* as shown in FIGS. 9, 10 includes a central U-shaped portion 25*a* slidably engageable with the middle rib 25 having a cross section of generally U-shape as coupled by a coupling ring 29, with the central U-shaped portion 25*u* having an inner arm portion 25*i* having a height H above a bottom portion of the middle rib 25 and having an outer arm portion 25*j* of the central U-shaped portion 25*u* having a height h above the bottom portion of the middle rib 25, the coupling ring 29 limited in between the inner arm portion 25*i* and the outer arm portion 25*j*, and the bottom portion of the middle rib 25 having a thickness of "t", a formula being obtained as:

$$H>h>(d-t)$$

where "d" is the inside diameter of the coupling ring. Whereby upon an upward bending as subjected to an upward wind force W, the inward movement of the coupling ring 29 will be retarded by the higher inner arm portion 25*i* to prevent dogging of the U-shaped portion 25*u* with the coupling ring 29.

Each retraction restoring or closing spring 6 has an inner spring end portion 61 secured to an inner portion of the connection rib 22*a* and an outer spring end portion 62 secured to an outer portion of the top rib 22 adjacent to the joint member 28 as shown in FIG. 9.

The extending or opening spring 5 has its lower spring end portion 51 retained on an upper sleeve portion of the lower sleeve 13 and an upper spring end portion 52 retained against the inner block 123 of the upper shaft 12.

The control means 4 includes: a push button 41 slidably held in a button hole formed in the grip 3 at a first side 3*a* of the grip, an opening controller 42, and a closing controller 43.

The opening controller 42 includes: a pair of bifurcated members 421 bifurcated forwardly towards the first side 3*a* of the grip 3 and slidably held in a middle transverse hole 32 formed in a central portion of the grip 3 to be normally contacting with the inside button surface of the push button 41 and slidably disposing about an outer circumferential surface of the upper shaft 12, a wedge portion 422 tapered downwardly inwardly towards the longitudinal axis 100 of the central shaft means 1 and secured to each rear portion of the bifurcated members 421, and a controller restoring spring 423 held in a spring socket formed in the grip 3 for urging the wedge portion 422 through the middle transverse hole 32 to be engaged with either engaging holes 122, 122*b* of the upper shaft 12 when closing the umbrella, and also for urging the bifurcated members 421 forwardly to protrude the push button 41 outwardly ready for a depression operation.

The closing controller 43 includes: a pushing rod 430 pivotally mounted in the socket of the push button 41 by a pivot 430*a* and normally restored horizontally by a restoring spring 430*b* to protrude from the inside button surface towards the second side 3*b* of the grip 3 having an arcuate tip end 430*c* formed on an inner end of the rod 430 which is operatively depressed downwardly by the lower end portion 151 of the middle shaft 15 when folding the folded umbrella; a locking head means 440 having a locking head portion 441 formed with an arcuate bottom portion on a bottom portion of the locking head portion 441; and a rope 450 having a lower rope portion connected with the locking head means 440 and having an upper rope end portion secured to the inner block 123 adjacent to the upper notch 21 by passing the rope 450 through a central portion of the shaft means 1, the upper sleeve 14 and deflectively winding the rope 450 on the upper guiding roller 124*a* formed on the inner block 123 downwardly to the lower runner 24 and then deflectively winding the rope upwardly through a lower guiding roller 241*a* pivotally secured on a roller shaft 241*c* integrally formed on the lower runner 24 and the rope 450 finally upwardly extended to the inner block 123 adjacent to the upper notch 21. The lower runner 24 as shown in FIG.

2 includes a rope guiding member 240*a* longitudinally formed on the runner 24 provided with two rope grooves 240*b* disposed in two opposite sides of a central partition stem 240*c* of the rope guiding member 240*a* for an easy winding of the rope on the roller 241*a* rotatably mounted on a roller shaft 241*c* integrally formed on the runner 24; a roller cover 241*b* having a shaft hole 241*d* formed in the cover and engaged with the roller shaft 241*c* for covering the roller 241*a*, with the roller cover 241*b* having a pair of upper protrusions 241*a* clamping the central partition stem 240*c*, and having a lower protrusion 241*f* embedded in a protrusion socket 241*g* recessed in a lower portion of the runner 24 for fixing the cover 241*b* on the runner 24. The locking head portion 441 provided with the arcuate bottom portion as universally held on a lower sleeve end 141 will be biased by a resilient plate 134*b* (as shown in FIG. 3) protruding towards the first side 3*a* when lowered in the lower sleeve 13 when folding the umbrella as shown in FIG. 1 to be locked on the triangular block portion 131. The resilient plate 134*b* is convex inwardly in the central shaft means 1 having a flat spring portion 134*c* disposed between two angled spring portions 134*d* for preventing deformation of the resilient plate 134*b* when resiliently biasing the locking head portion 441 of the umbrella control means 4 for opening and closing the umbrella. The locking head portion 441 may also be disengaged from the triangular block portion 131 when inwardly pushed by the pushing rod 430 for closing the umbrella from its opened state.

When folding the umbrella from an opening state to be at the closed state by engaging the wedge portion 422 with the lowest engaging hole 122*b* formed in the upper shaft 12 as shown in FIG. 1, the folded umbrella may be further retracted to receive the tips 261 of the rear ribs 26 into the central portion 30 in the grip 3 for minimizing the volume of the folded umbrella as shown in FIG. 4. At this time, the upper shaft 12 is depressed downwardly by compressing the coupling spring 17*a* held between the inner block 123 under the upper notch 21 and the middle shaft 15 and the wedge portion 422 is engaged with the lower engaging hole 122 for locking the folded shafts 1 and rib means 2 as in FIG. 4.

The present invention is superior to the parent application U.S. Ser. No.: 08/654,142 with the following advantages:

1. Easy winding of rope 450 into the two rope grooves 240*b* on the runner since the grooves 240*b* are open to the surroundings for an easy access of the rope.

2. The coupling spring 17*a* provides a two-step retraction the central shaft means 1 as shown in FIGS. 1, 4, thereby retracting the rib tips 261 into the grip 3 for minimizing a folding volume of the closed umbrella.

3. The resilient plate 134*b* provides a flat spring portion 134*c* and two angled spring portions 134*d* for resisting deformation of the resilient plate 134*b*.

4. The engaging hole originally formed in the middle shaft 15 is now eliminated; and the engaging holes 122, 122*b* are formed on the upper shaft 12, simplifying the production and also allowing the two-step retraction of the shaft means 1 as shown in FIGS. 1 and 4.

5. The central U-shaped portion 25*u* of the resilient rib 25*a* having a higher inner arm portion 25*i* will prevent dogging with the coupling ring 29 to ensure a smooth operation of the umbrella.

The present invention may be modified without departing from the spirit and scope of this invention.

I claim:

1. An automatic umbrella comprising:

a central shaft means defining a longitudinal axis therein and having an upper tubular shaft slidably telescopically engageable with a middle tubular shaft, said middle tubular shaft telescopically engageable with a lower tubular shaft, said lower tubular shaft secured on a grip, an inner block formed in an upper end portion of the upper shaft having an upper guiding roller rotatably mounted in the inner block, a lower sleeve fixed in the grip within the lower shaft having a triangular block portion formed in the lower sleeve inclined inwardly downwardly, and an upper sleeve fixed in the inner block of the upper shaft;

a rib assembly having at least a top rib pivotally secured to an upper notch fixed on a top portion of said upper shaft, a stretcher rib pivotally secured with said top rib and pivotally secured to a lower runner slidably held on said central shaft means, a middle rib secured to a middle joint member pivotally connected with the top rib, a rear rib secured to an outer joint member pivotally connected with the middle rib, a connection rib pivotally connected between the stretcher rib and the middle joint member, and a resilient rib connected between the top rib and the outer joint member;

an extending spring retained in between said inner block and said lower sleeve for operatively opening the umbrella, and said extending spring disposed around said upper sleeve;

a plurality of retraction restoring springs each said retraction restoring spring having an inner spring end secured on said connection rib and an outer spring end secured to said top rib for operatively closing the umbrella from an opened state of the umbrella; and a control means including: a push button slidably held in the grip at the first side of the grip; an opening controller having a pair of bifurcated members bifurcated towards the first side of the grip and slidably held in a central portion of the grip to be normally contacting with the push button and slidably disposing about an outer circumferential surface of the upper shaft, a wedge portion tapered downwardly inwardly towards said longitudinal axis of the central shaft means and formed on a rear portion of the bifurcated members and engageable with at least one engaging hole formed in said upper shaft, and a controller restoring spring held in a spring socket formed in the grip at the second side of the grip for urging the wedge portion to be engaged with the engaging hole of the upper shaft when closing the umbrella; a closing controller having a pushing rod pivotally secured in said push button and normally restored horizontally and protruding horizontally towards the second side of the grip through a rod hole respectively formed in said lower shaft and in said lower sleeve; a locking head means having a locking head portion formed on a bottom portion of the locking head portion; and a rope having a lower rope portion connected to the locking head portion and having an upper rope end portion secured to the inner block adjacent to the upper notch by passing the rope through a central portion of the shaft means, the upper sleeve and deflectively winding the rope on the upper guiding roller formed on the inner block downwardly to the lower runner and then deflectively winding the rope upwardly through a lower guiding roller rotatably mounted on the lower runner to be upwardly extended to the upper notch, said locking head portion, upon the folding of the umbrella, operatively biased by a resilient plate protruding inwardly from the lower sleeve at the second side of the grip to be locked on the triangular block portion formed on the lower sleeve at the first side of the grip; and the locking head portion operatively disengaged from the triangular block portion of the lower sleeve when thrusted by the pushing rod when closing an opened umbrella;

the improvement which comprises:

said lower runner including a rope guiding member longitudinally formed on said runner having two rope grooves disposed in two opposite sides of a central partition stem of the rope guiding member for an easy winding of said rope on the lower guiding roller rotatably mounted on a roller shaft formed on said runner; a coupling spring resiliently retained between said inner block adjacent said upper notch and an upper portion of said middle shaft;

said tipper shaft having a lower engaging hole formed in a lower portion of the upper shaft, a lower convex portion curved outwardly from the longitudinal axis of the shaft means and positioned below said lower engaging hole, a lowest engaging hole formed in a lowest portion of the upper shaft below the lower convex portion, and a lowest convex portion positioned below the lowest engaging hole adjacent to a lower end portion of said upper shaft, each said engaging hole engageable with said wedge portion of said control means; and said resilient rib including a central U-shaped portion slidably engageable with the middle rib with a coupling ring, said central U-shaped portion having an inner arm portion higher than said coupling ring for preventing dogging by said coupling ring with said central U-shaped portion when upwardly bending an opened umbrella rib means.

2. An automatic umbrella according to claim 1, wherein said lower runner includes a roller cover having a shaft hole engageable with said roller shaft for covering said lower guiding roller, said roller cover having a pair of upper protrusions clamping the central portion stem and having a lower protrusion embedded in a protrusion socket recessed in a lower portion of the runner for fixing said loller cover on said runner.

3. An automatic umbrella according to claim 1, wherein said resilient plate operatively resiliently biasing said locking head portion of said control means is convex inwardly towards the longitudinal axis of said central shaft means, having a flat spring portion disposed between two angled spring portions on said resilient plate for resiliently biasing said locking head portion.

4. An automatic umbrella according to claim 1, wherein said central U-shaped portion of said resilient rib includes said inner arm portion having a height H above a bottom portion of the middle rib and an outer arm portion of the central U-shaped portion having a height h above the bottom portion of said middle rib, said bottom portion of the middle rib having a thickness t and said coupling ring having an inside diameter d, obtaining a formula of:

$$H>h>(d-t).$$

* * * * *